US012264433B2

(12) United States Patent
Kondo et al.

(10) Patent No.: US 12,264,433 B2
(45) Date of Patent: Apr. 1, 2025

(54) CLOTH SPREADING APPARATUS

(71) Applicant: PUREX CO., LTD., Takamatsu (JP)

(72) Inventors: Masanori Kondo, Takamatsu (JP); Tomoyuki Tanii, Takamatsu (JP); Masashi Ido, Takamatsu (JP); Shinji Kato, Takamatsu (JP)

(73) Assignee: PUREX CO., LTD., Takamatsu (JP)

( * ) Notice: Subject to any disclaimer, the term of this patent is extended or adjusted under 35 U.S.C. 154(b) by 300 days.

(21) Appl. No.: 18/009,183

(22) PCT Filed: Jun. 17, 2021

(86) PCT No.: PCT/JP2021/023060
§ 371 (c)(1),
(2) Date: Dec. 8, 2022

(87) PCT Pub. No.: WO2021/256541
PCT Pub. Date: Dec. 23, 2021

(65) Prior Publication Data

US 2023/0257927 A1 Aug. 17, 2023

(30) Foreign Application Priority Data

Jun. 19, 2020 (JP) ..... 2020-106438

(51) Int. Cl.
*D06F 67/04* (2006.01)
*D06C 3/08* (2006.01)

(52) U.S. Cl.
CPC ..... *D06F 67/04* (2013.01); *D06C 3/08* (2013.01)

(58) Field of Classification Search
CPC ..... D06F 67/04; D06F 71/38; D06C 3/00; D06C 3/08; B65G 47/04
See application file for complete search history.

(56) References Cited

U.S. PATENT DOCUMENTS 3,553,861 A * 1/1971 Orkney et al. ..... D06F 67/04 38/143
3,657,832 A * 4/1972 Valentine ..... D06F 67/04 38/143

(Continued)

FOREIGN PATENT DOCUMENTS

EP 3 578 702 A1 12/2019
JP 2006-233374 A 9/2006

(Continued)

OTHER PUBLICATIONS

Aug. 10, 2021 International Search Report issued in Patent Application No. PCT/JP2021/023060.

(Continued)

*Primary Examiner* — Nathan E Durham
(74) *Attorney, Agent, or Firm* — Oliff PLC

(57) ABSTRACT

A cloth spreading apparatus includes: a spreading unit having spreading clamps that spread an upper-side part of a fed cloth in a right-left direction; and an ejection unit having an intermediate movable body that releases the upper-side part of the cloth that the intermediate movable body has received from the spreading clamps in the forward position and held onto an upper surface by sucking, and a belt conveyor that receives the upper-side part of the cloth released by the intermediate movable body and ejects the entire cloth backward. The ejection unit has: a large number of suction holes that are dispersedly disposed in the intermediate movable body's upper surface; a negative pressure source that sucks out air inside the intermediate movable body to form a negative pressure region inside the intermediate movable body; and sucking force maintaining means that maintains a sucking force of the suction holes

16 Claims, 5 Drawing Sheets

(56) References Cited

U.S. PATENT DOCUMENTS

| | | | | |
|---|---|---|---|---|
| 5,430,915 | A | 7/1995 | Ueda et al. | |
| 8,845,259 | B2 | 9/2014 | Nielsen et al. | |
| 9,873,975 | B2 | 1/2018 | Nielsen et al. | |
| 11,066,769 | B2 | 7/2021 | Yano et al. | |
| 2017/0204555 | A1* | 7/2017 | Tanii | B65H 5/14 |
| 2020/0158780 | A1 | 5/2020 | Ranganathan et al. | |
| 2020/0173097 | A1 | 6/2020 | Hayashida et al. | |

FOREIGN PATENT DOCUMENTS

| | | | |
|---|---|---|---|
| JP | 2009-268571 | A | 11/2009 |
| JP | 2011-506792 | A | 3/2011 |
| JP | 2018-201895 | A | 12/2018 |
| WO | 2009/076958 | A1 | 6/2009 |

OTHER PUBLICATIONS

Oct. 19, 2023 extended Search Report issued in European Patent Application No. 21825774.9.

* cited by examiner

CLOTH SPREADING APPARATUS

TECHNICAL FIELD

The present invention relates to a cloth spreading apparatus that, at a cloth washing factory or the like, spreads washed cloths one by one so as to be fed onto an iron roller or the like in the next process, and particularly to a cloth spreading apparatus that inexpensively achieves fall prevention of cloths by maintaining a sucking force of an intermediate movable body regardless of whether the lateral width of the cloth is large or small.

BACKGROUND ART

Examples of known conventional cloth spreading apparatuses include the one described in Patent Literature 1 that was previously disclosed by the applicant of this application. This cloth spreading apparatus includes a cloth feeding unit, a spreading unit that spreads fed cloths in a right-left direction, and an ejection unit that ejects the spread cloths. Here, the feeding unit has a pair of feeding clamps that grasps adjacent corners of a cloth in a feeding position, and a raising-lowering device that moves the pair of feeding clamps up and down between the feeding position and a delivery position at a higher level than the feeding position. The spreading unit has a pair of spreading clamps that receives the adjacent corners of the cloth from the pair of feeding clamps in the delivery position of the feeding clamps and grasps these corners, and a lateral moving device that laterally moves the pair of spreading clamps so as to spread the cloth in the right-left direction. The ejection unit has an intermediate movable body that, in a forward position, receives an upper-side part of the cloth having been spread in the right-left direction from the spreading clamps and moves backward while holding the upper-side part by sucking, and a belt conveyor that receives the upper-side part of the cloth that the intermediate movable body has released while moving backward, and pulls in the upper-side part backward and also sequentially pulls up the rest of the cloth under the upper-side part to eject the entire cloth backward.

In such a conventional cloth spreading apparatus, a worker picks up adjacent corners of a washed cloth and makes the pair of feeding clamps in the feeding position respectively grasp these corners. Then, the raising-lowering device raises the pair of feeding clamps to the delivery position, and the pair of spreading clamps receives the adjacent corners of the cloth from the pair of feeding clamps in the delivery position and grasps these corners. The lateral moving device laterally moves the pair of spreading clamps in directions away from each other so as to spread the cloth in the right-left direction. In the forward position, the intermediate movable body receives the upper-side part of the cloth thus having been spread in the right-left direction from the spreading clamps and moves backward while holding the upper-side part by sucking. The belt conveyor receives the upper-side part of the cloth that the intermediate movable body has released while moving backward, and pulls in the upper-side part backward and also sequentially pulls up the rest of the cloth under the upper-side part to eject the entire cloth backward.

CITATION LIST

Patent Literature

Patent Literature 1: JP-A-2009-268571

SUMMARY OF INVENTION

Technical Problem

However, this conventional cloth spreading apparatus has the following problem. A negative pressure region is formed in the entire inside of the intermediate movable body in the right-left direction by a negative pressure source, and a large number of suction holes formed in a substantially entire upper surface of the intermediate movable body in the right-left direction communicate with the negative pressure region inside the intermediate movable body. Thus, depending on whether the lateral width of the upper-side part of the cloth to be held by sucking is large or small, a range of suction holes that are not covered by the upper-side part of the cloth varies. When the lateral width of the upper-side part of the cloth is small, a wider range of suction holes are left open without being covered by the upper-side part than when the lateral width is large. As air enters inside the intermediate movable body through these suction holes, the suction force of the negative pressure region decreases, and consequently the sucking force of the intermediate movable body for sucking the upper-side part of the cloth decreases.

To solve this problem, it is conceivable to provide a negative pressure source having a high suction force and generate its high suction force at all times such that, even when the suction force of the negative pressure region decreases to the lowest level, the sucking force of the intermediate movable body can be maintained at such strength as to be able to reliably suck the upper-side part of the cloth. It turned out, however, that doing so led to a new problem in the form of an increased cost of the negative pressure source and thereby of the cloth spreading apparatus as well as increased power consumption of the negative pressure source during operation of the cloth spreading apparatus.

Solution to Problem

The present invention solves the problems faced by the conventional cloth spreading apparatus as described above, and a cloth spreading apparatus of the present invention includes:

a spreading unit having a pair of spreading clamps that grasps adjacent corners of a fed cloth and spreads at least an upper-side part of the cloth between the corners in a right-left direction; and an ejection unit having:

an intermediate movable body that, while moving backward from a forward position, releases the upper-side part of the cloth that the intermediate movable body has received from the pair of spreading clamps in the forward position and held onto an upper surface by sucking; and a belt conveyor that receives the upper-side part of the cloth having been released by the intermediate movable body, and pulls in the upper-side part and also sequentially pulls up the rest of the cloth under the upper-side part to eject the entire cloth backward.

The cloth spreading apparatus is characterized in that the ejection unit has:

a large number of suction holes that are dispersedly disposed in the upper surface of the intermediate movable body, at least over a lateral range corresponding to a set maximum lateral width of the upper-side part of the cloth, and allow communication between an inside and an outside of the intermediate movable body;

a negative pressure source that sucks out air inside the intermediate movable body to form a negative pressure region inside the intermediate movable body; and sucking force maintaining means that maintains a sucking force with which the suction holes suck the upper-side part of the cloth, regardless of whether the lateral width of the upper-side part of the cloth is large or small.

Advantageous Effects of Invention

In the cloth spreading apparatus of the present invention, when a washed cloth is fed into the apparatus by a worker etc., the spreading unit grasps adjacent corners of the fed cloth and spreads at least the upper-side part between these corners in the right-left direction by the pair of spreading clamps. The ejection unit receives the upper-side part of the cloth from the pair of spreading clamps onto the upper surface of the intermediate movable body in the forward position and holds the upper-side part by sucking. Then, the ejection unit causes the intermediate movable body to release the upper-side part of the cloth while moving backward from the forward position. Further, by the belt conveyor, the ejection unit receives the released upper-side part of the cloth, and pulls in the upper-side part backward and also sequentially pulls up the rest of the cloth under the upper-side part to eject the entire cloth backward.

In the cloth spreading apparatus of the present invention, the ejection unit includes the large number of suction holes that are dispersedly disposed in the upper surface of the intermediate movable body, at least over the lateral range corresponding to the set maximum lateral width of the upper-side part of the cloth, and allow communication between the inside and the outside of the intermediate movable body. The sucking force with which these suction holes suck the upper-side part of the cloth by communicating with the negative pressure region that is formed inside the intermediate movable body as the negative pressure source sucks out air inside the intermediate movable body by a suction force is maintained by the sucking force maintaining means at such strength as to be able to reliably suck the upper-side part of the cloth regardless of whether the lateral width of the upper-side part of the cloth is large or small.

Thus, according to the cloth spreading apparatus of the present invention, the sucking force of the intermediate movable body can be maintained at such strength as to be able to reliably suck the upper-side part of the cloth, without the need to provide a negative pressure source having a high suction force or to generate the high suction force of that negative pressure source at all times. It is therefore possible to inexpensively prevent cloths from falling from the intermediate movable body by achieving a lower cost of the negative pressure source and thereby of the cloth spreading apparatus and/or a reduction in power consumption of the negative pressure source during operation of the cloth spreading apparatus.

In the cloth spreading apparatus of the present invention, it is preferable that:

inside the intermediate movable body, partitioned regions be defined at a plurality of locations in the right-left direction by partition members that are fixedly disposed; and the sucking force maintaining means turn those of the partitioned regions at the plurality of locations inside the intermediate movable body that are located at least partially within a lateral range corresponding to a lateral width of the upper-side part of the cloth into the negative pressure region by means of the negative pressure source that is shared.

In the cloth spreading apparatus of the present invention, it is also preferable that:

inside the intermediate movable body, partitioned regions be defined at a plurality of locations in the right-left direction by partition members that are fixedly disposed; and the sucking force maintaining means have the negative pressure sources separately provided so as to correspond to the respective partitioned regions at the plurality of locations inside the intermediate movable body, and turn those of the partitioned regions at the plurality of locations that are located at least partially within a lateral range corresponding to a lateral width of the upper-side part of the cloth into the negative pressure region by means of the separate negative pressure sources corresponding to those partitioned regions.

On the other hand, in the cloth spreading apparatus of the present invention, it is preferable that:

inside the intermediate movable body, the negative pressure region be defined by the negative pressure source at least over the lateral range corresponding to the set maximum lateral width of the upper-side part of the cloth; and the sucking force maintaining means cover those of the suction holes that are located outside a lateral range corresponding to a lateral width of the upper-side part of the cloth so as to shut off those suction holes from the negative pressure region.

In the cloth spreading apparatus of the present invention, it is also preferable that:

inside the intermediate movable body, the negative pressure region be defined by the negative pressure source at least over the lateral range corresponding to the set maximum lateral width of the upper-side part of the cloth; and the sucking force maintaining means control the suction force of the negative pressure source so as to secure the sucking force with which the suction holes suck the upper-side part of the cloth, regardless of whether the lateral width of the upper-side part of the cloth is large or small.

Further, in the cloth spreading apparatus of the present invention, it is preferable that:

partition members that are movable in the right-left direction be disposed inside the intermediate movable body; and the sucking force maintaining means define a partitioned region inside the intermediate movable body, over a lateral range corresponding to a lateral width of the upper-side part of the cloth, by moving the partition members in the right-left direction, and turn this partitioned region into the negative pressure region by means of the negative pressure source.

Further, in the cloth spreading apparatus of the present invention, it is preferable that the negative pressure source be fixedly disposed in the cloth spreading apparatus and connected to the inside of the intermediate movable body through a deformable duct.

Further, in the cloth spreading apparatus of the present invention, it is preferable that:

the ejection unit have a cloth width measurement part that measures a lateral width of the cloth from an amount of movement of each of the pair of spreading clamps upon spreading at least the upper-side part of the cloth in the right-left direction; and based on the measured lateral width of the cloth, the sucking force maintaining means maintain the sucking force with which the cloth is sucked onto the upper surface of the intermediate movable body.

In the cloth spreading apparatus of the present invention, it is also preferable that:

the ejection unit have a cloth width measurement part that measures a lateral width of the cloth in a state where at least the upper-side part has been spread in the right-left direction by the pair of spreading clamps; and based on the measured lateral width of the cloth, the sucking force maintaining means maintain the sucking force with which the cloth is sucked onto the upper surface of the intermediate movable body.

In addition, in the cloth spreading apparatus of the present invention, it is preferable that:

the ejection unit have a cloth width input unit for inputting a predetermined lateral width of the cloth; and based on the input lateral width of the cloth, the sucking force maintaining means maintain the sucking force with which the cloth is sucked onto the upper surface of the intermediate movable body.

DESCRIPTION OF EMBODIMENTS

Figure 1:
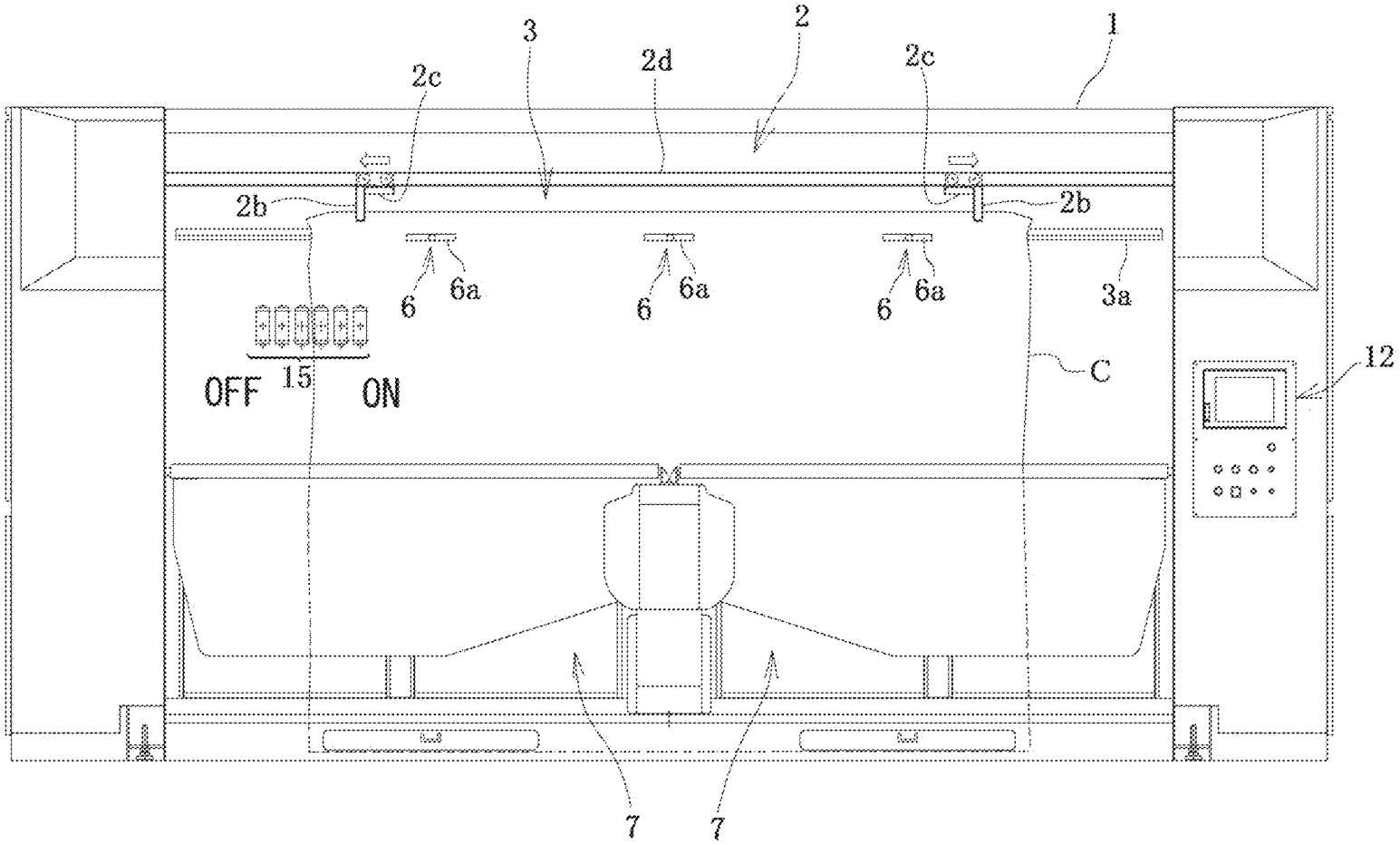
FIG. 1 is a front view showing the configuration of one embodiment of a cloth spreading apparatus of the present invention, with feeding units omitted.
Figure 2:
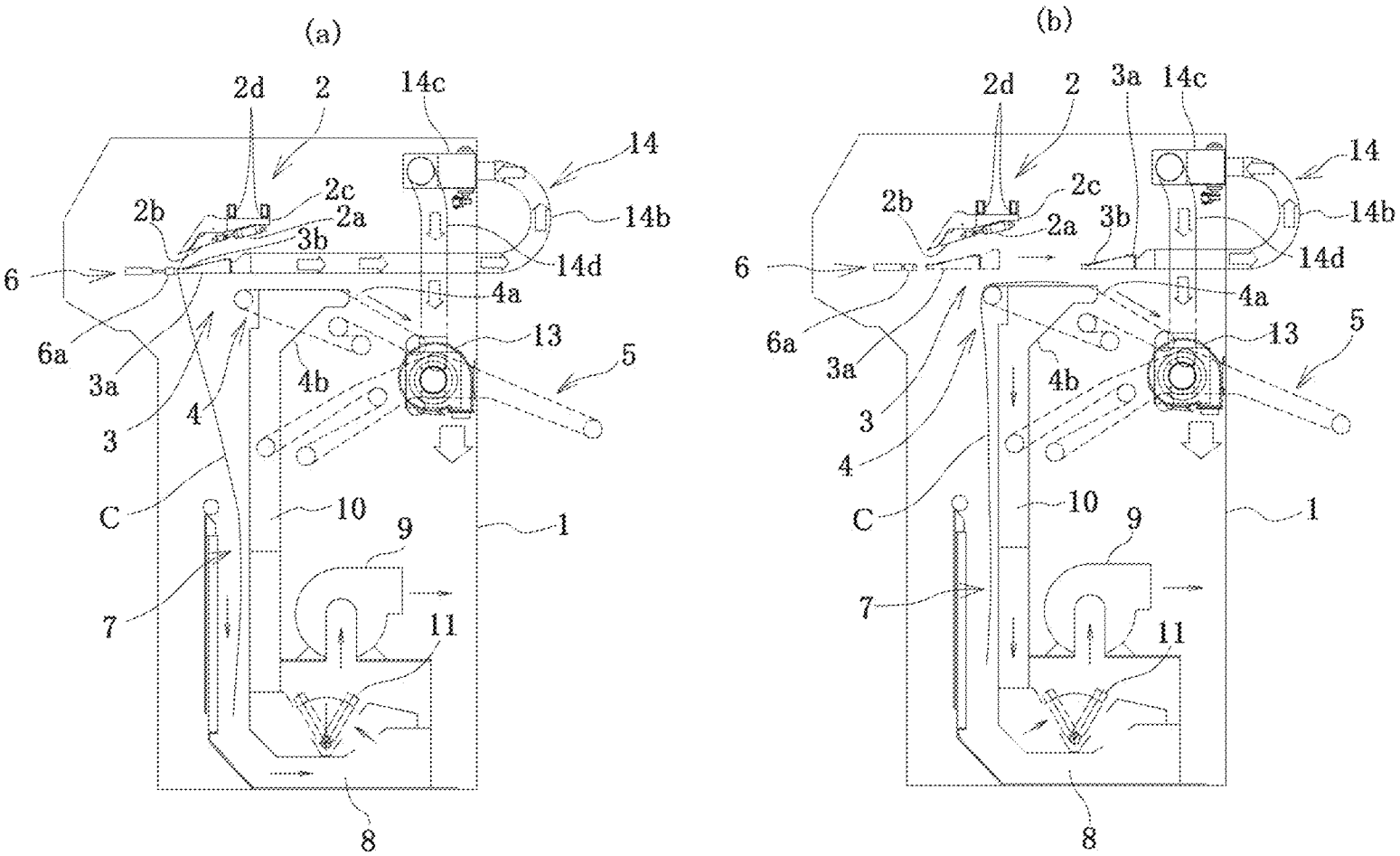
FIGS. 2 (*a*) and (*b*) are side views showing the configuration of the cloth spreading apparatus of the embodiment as seen through, respectively in a state where an intermediate movable body is in a forward position and in a state where the intermediate movable body is moving backward.

An embodiment of the present invention will be described in detail below based on the drawings. Here, FIG. 1 is a front view showing the configuration of one embodiment of a cloth spreading apparatus of the present invention, with cloth feeding units omitted. FIG. 2 (*a*) and FIG. 2 (*b*) are side views showing the configuration of the cloth spreading apparatus of the embodiment as seen through, respectively in a state where an intermediate movable body is in a forward position and in a state where the intermediate movable body is moving backward. In the drawings, reference signs 1, 2, and 3 respectively denote an apparatus main body of the cloth spreading apparatus, a spreading unit that spreads fed cloths in a right-left direction, and an ejection unit that ejects the spread cloths.

Thus, as with the conventional cloth spreading apparatus described earlier, the cloth spreading apparatus of this embodiment also spreads washed cloths one by one so as to be fed onto an iron roller at a cloth washing factory or the like. On a front side of the apparatus main body 1, for example, three feeding units (not shown) are provided at intervals at a central part and right and left side parts of the apparatus main body 1. Each feeding unit has two sets of feeding clamps making a pair that grasp portions of a cloth near end corners of a long side etc. as adjacent corners of the cloth, a clamp base on which these two sets of feeding clamps are fixed side by side in the right-left direction, and a raising-lowering device that moves the clamp base up and down.

The raising-lowering device has: a driving mechanism that drives, by a servomotor, a step motor, or the like, an endless timing belt that, for example, extends obliquely from a front lower side toward a back upper side of the apparatus main body 1 and is partially coupled to the clamp base; and a guide mechanism that extends obliquely along this timing belt and guides the upward and downward motion of the clamp base. As the clamp base is driven to move up and down by the driving mechanism under the guidance of the guide mechanism, the pair of feeding clamps can be moved up and down between a feeding position that is set roughly at the level of the chests of workers to mitigate the work burden on workers, and a delivery position that is set at a higher level than the feeding position such that a lower-side part of a cloth does not trail on a floor surface while being spread. The driving mechanism may be formed using an actuator, such as an air cylinder or a linear motor, instead of a servomotor, a step motor, or the like.

As shown in FIG. 1 and FIGS. 2 (*a*) and (*b*), the spreading unit 2 is provided at an upper part of the apparatus main body 1. The spreading unit 2 has: a pair of spreading clamps 2*b* that is opened and closed by air cylinders 2*a* and respectively grasps the end corners of one side of a cloth C, such as the long side; a pair of carriages 2*c* on which the spreading clamps 2*b* are respectively fixed; a rail 2*d* that extends in the right-left direction at an upper part of the apparatus main body 1 and guides the horizontal motion of the carriages 2*c* in the right-left direction; and a lateral moving device (not shown) that can move the pair of carriages 2*c* independently of each other.

The lateral moving device is configured to drive, by a servomotor, a step motor, or the like, an endless timing belt that extends along the rail 2*d* and is partially coupled to the carriages 2*c*. By moving the timing belt along the rail 2*d*, the lateral moving device can move the pair of spreading clamps 2*b* under the guidance of the rail 2*d* independently of or in conjunction with each other. Thus, after receiving portions of the cloth C near the end corners of the upper-side part from the pair of feeding clamps having been raised to the delivery position and grasping these portions, the lateral moving device can pull these portions of the cloth C near the end corners in directions away from each other so as to spread at least the upper-side part of the cloth C in the right-left direction of the apparatus main body 1 as shown in FIG. 1. The lateral moving device may also drive the carriages 2*c* using another actuator capable of speed and position control, instead of a servomotor, a step motor, or the like.

The ejection unit 3 is disposed under the spreading unit 2. The ejection unit 3 has: a catch base 3*a* as the intermediate movable body that extends horizontally in the right-left direction of the apparatus main body 1 and holds, by sucking, the upper-side part of the cloth C onto a large number of suction holes 3*b* in an upper surface thereof by the action of a negative pressure introduced into the catch base 3*a*; a forward-backward moving device (not shown) that moves the catch base 3*a* back and forth in a front-rear direction of the apparatus main body 1; a primary conveyor 4 as a belt conveyor that is located under the catch base 3*a*; and a secondary conveyor 5 also as a belt conveyor that continues from a back side of the primary conveyor 4. Here, as with conventional conveyors, the primary conveyor 4 and the secondary conveyor 5 are both composed of a large number of endless conveyor belts that extend in the front-rear direction of the apparatus main body 1 and are arrayed in the right-left direction.

The forward-backward moving device has: driving mechanisms that drive, by a servomotor, a step motor, or the like, endless timing belts that, for example, extend horizontally in the front-rear direction of the apparatus main body 1 at left and right side parts inside the apparatus main body 1 and are partially coupled to the catch base 3*a*; and guide mechanisms that guide the horizontal motion of the catch base 3*a* by rails extending horizontally in the front-rear direction of the apparatus main body 1 along the timing belts at left and right side parts inside the apparatus main body 1 and extending horizontally in the front-rear direction of the apparatus main body 1 also at a central part inside the apparatus main body 1. The back-forth moving device can horizontally move the catch base 3*a* back and forth between the forward position shown in FIG. 2 (*a*) and the backward position shown in FIG. 2 (*b*) by the driving mechanisms under the guidance of the guide mechanisms. Thus, the catch base 3*a* having been moved to the forward position can receive the upper-side part of the cloth C having been spread in the right-left direction from the pair of spreading clamps 2*b* and hold the upper-side part by sucking.

As shown in FIG. 2 (*a*), the ejection unit 3 further has temporary holding devices 6 that are disposed at a plurality of locations, for example, three locations, in the right-left direction at a front part of the apparatus main body 1, and that press a rod-shaped temporary holding member 6*a* against a front end part of the catch base 3*a* located in the forward position by an air cylinder or the like so as to temporarily hold the spread upper-side part of the cloth C between the temporary holding member 6*a* and the front end part of the catch base 3*a*. By temporarily holding the upper-side part of the cloth C by the temporary holding device 6, the ejection unit 3 can reliably suck the upper-side part having been released from the spreading clamps 2*b* onto the upper surface of the catch base 3*a* as is in the spread state, without letting the cloth C fall.

The catch base 3*a* has a shape of a long thin box with a small thickness that extends in the right-left direction of the apparatus main body 1. In the forward position, the catch base 3*a* receives the upper-side part of the cloth C having been spread in the right-left direction from the spreading clamps 2*b* as is in the spread state, and moves backward while holding, by sucking, the upper-side part onto the large number of suction holes 3*b* in the upper surface using a negative pressure that is exerted from inside. Thereafter, while the catch base 3*a* is thus moving backward, the negative pressure is stopped, so that the catch base 3*a* releases the upper-side part of the cloth C so as to shift the upper-side part of the cloth C onto the primary conveyor 4. The primary conveyor 4 has a conveyor belt 4*a* having a large number of small holes, and a vacuum box 4*b* disposed under a transfer surface of the conveyor belt 4*a*. The primary conveyor 4 can receive the upper-side part of the cloth C by the conveyor belt 4*a*, and pull in the upper-side part backward while holding it by sucking using a negative pressure from the vacuum box 4*b*, and also sequentially pull up the rest of the cloth C under the upper-side part to send out the entire cloth C backward. The secondary conveyor 5 can eject the cloth C backward and feed the cloth C onto an iron roller in the next process.

At a lower part on the front side of the apparatus main body 1, vertical spreading units 7 in the form of a passage that extends in an up-down direction and is open at an upper end are provided, and a lower part of each vertical spreading unit 7 is connected to a blower 9 through a duct 8. A second duct 10 is formed behind the vertical spreading unit 7, and this second duct 10 is configured to allow communication between the vacuum box 4*b* of the primary conveyor 4 and the blower 9. An opening-closing plate 11 is disposed between the ducts 8, 10 and the blower 9. By selectively opening and closing an opening of the duct 8 and an opening of the duct 10, the opening-closing plate 11 can switch between a state in which air is suctioned from the front side of the apparatus main body 1 into the vertical spreading unit 7 and a state in which the vacuum box 4*b* of the primary conveyor 4 is operated.

The cloth spreading apparatus of this embodiment further includes a controller 12. The controller 12 is formed by an ordinary computer having a central processing unit (CPU), a memory, and others. Based on programs given in advance, the controller 12 controls the operation of the raising-lowering device and the lateral moving device, the opening and closing of the spreading clamps 2*b*, the forward and backward motion of the catch base 3*a*, the generation and releasing of a negative pressure inside the catch base 3*a*, the operation of the temporary holding devices 6, the operation of the blower 9 and the opening-closing plate 11, and the operation of the primary conveyor 4 and the secondary conveyor 5. As the controller 12 controls the operation of the raising-lowering device and the lateral moving device, the feeding clamps and the spreading clamps 2*b* can be moved in synchronization to perform the action of handing over the end corners of one side that forms the upper-side part of the cloth C.

In the cloth spreading apparatus of this embodiment, a worker picks up adjacent corners of a long side of a washed cloth C that constitutes, for example, the upper side at the time of feeding, at one of the feeding units and makes the pair of feeding clamps in the feeding position respectively grasp these corners. Then, the raising-lowering device of that feeding unit raises the pair of feeding clamps to the delivery position. Meanwhile, the pair of spreading clamps 2*b* has moved in advance to the delivery position of that feeding unit and been waiting. The sets of feeding clamps are opened by operation of cams, for example, while passing by the respective spreading clamps 2*b* in the delivery position, and thereby delivery the corners of the cloth C to the spreading clamps 2*b*. At the same time, the spreading clamps 2*b* are closed and thereby receive and grasp the corners of the cloth C. The lateral moving device laterally moves the pair of spreading clamps 2*b* in directions away from each other so as to spread at least the upper-side part of the cloth C in the right-left direction. In the forward position, the catch base 3*a* receives the upper-side part of the cloth C thus having been spread in the right-left direction from the spreading clamps 2*b* in cooperation with the temporary holding device 6 and holds the upper-side part onto the suction holes 3*b* by sucking. While moving backward with the upper-side part of the cloth C held by sucking, the catch base 3*a* releases the upper-side part of the cloth C from the suction holes 3*b* as the negative pressure inside the catch base 3*a* is stopped.

Then, the primary conveyor 4 receives the upper-side part of the cloth C that the catch base 3*a* has released while moving backward onto the conveyor belt 4*a* and pulls in the upper-side part backward while holding it by sucking using the negative pressure inside the vacuum box 4*b*. Further, the primary conveyor 4 sequentially pulls up the rest of the cloth C under the upper-side part to send out the entire cloth C backward. While the primary conveyor 4 is pulling up the rest of the cloth C, the vertical spreading unit 7 pulls the rest of the cloth C into itself through the upper-end opening thereof by a negative pressure and spreads the cloth C also in the up-down direction. Thereafter, the secondary conveyor 5 receives the cloth C from the primary conveyor 4, ejects it backward, and feeds it onto the iron roller (not shown) in the next process.

In the cloth spreading apparatus of this embodiment, the suction holes 3*b* are dispersedly disposed in a large number in a holding surface that is roughly front half of the upper surface of the catch base 3*a* and slopes slightly toward the front side, at least over a lateral range corresponding to a set maximum lateral width of the upper-side part of the cloth C, i.e., a maximum lateral width that this cloth spreading apparatus can spread, and allow communication between the inside and the outside of the box-shaped catch base 3*a*. It suffices that the suction holes 3*b* are dispersedly disposed over the lateral range corresponding to the set maximum lateral width of the upper-side part of the cloth C; therefore, there may be a narrow region where the suction holes 3*b* are partially absent, for example, at a central part of the upper surface of the catch base 3*a* in the right-left direction. The cloth spreading apparatus of this embodiment further has a fan motor 13 as a negative pressure source that sucks out air inside the box-shaped catch base 3*a* to form a negative pressure region inside the catch base 3*a*, and sucking force maintaining means 14 that maintains the sucking force with which the suction holes 3*b* of the catch base 3*a* suck the upper-side part of the cloth C, regardless of whether the lateral width of the upper-side part of the cloth C is large or small.

Figure 3:
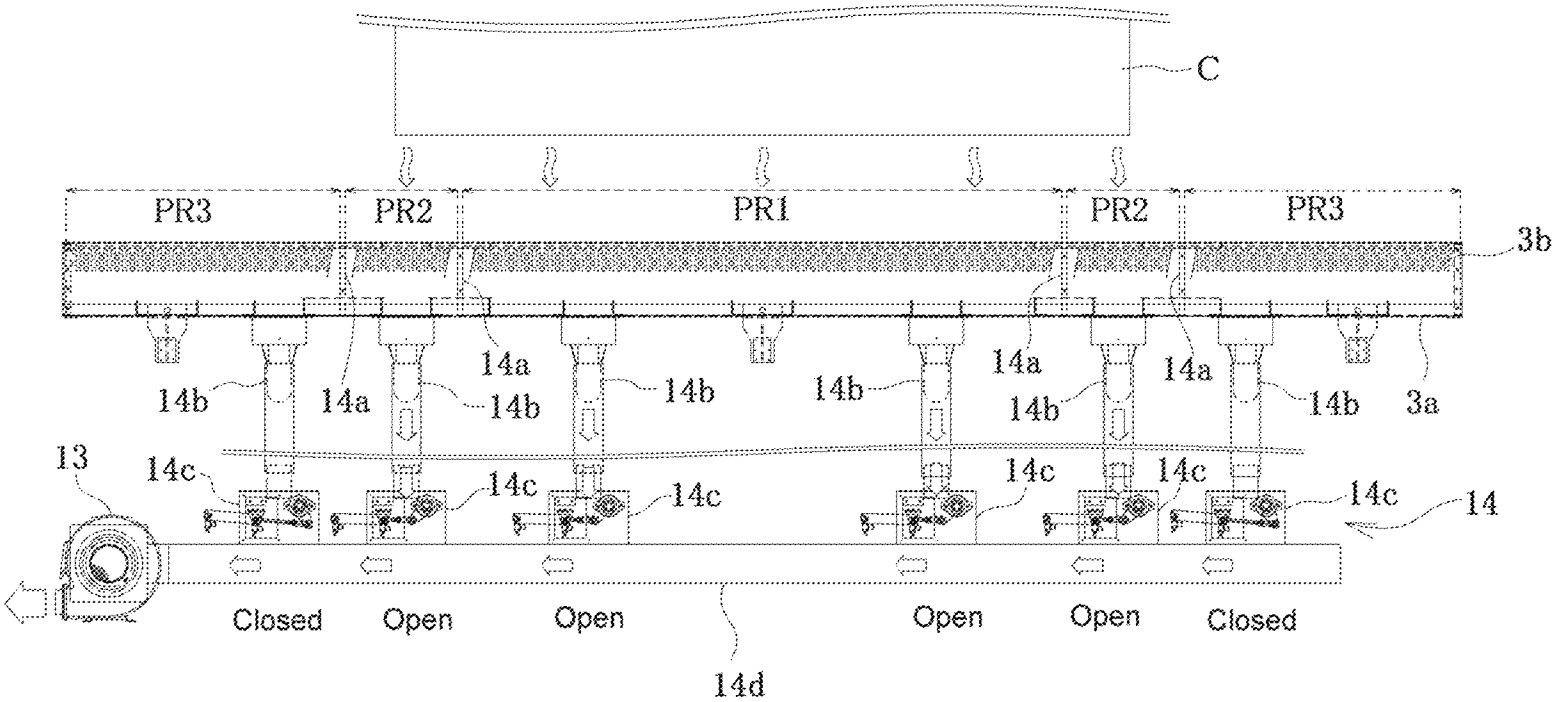
FIG. 3 is an illustration showing one example of the configuration of an ejection unit of the cloth spreading apparatus of the embodiment in a state where the intermediate movable body is seen from above.

FIG. 3 is an illustration showing one example of the configuration of the ejection unit 3 of the cloth spreading apparatus of the above embodiment in a state where the catch base 3*a* as the intermediate movable body is seen from above. In this example of the configuration, partitioned regions at a plurality of locations in the right-left direction, namely, in the shown example, a partitioned region PR1 at one location in a central part, partitioned regions PR3 at two locations in right and left side parts, and partitioned regions PR2 at two locations in intermediate parts between the partitioned regions PR1, PR3, are defined by partition plates 14*a* as partition members that are fixedly disposed inside the catch base 3*a*. As shown in FIGS. 2 (*a*) and (*b*), each of the partitioned regions PR1 to 3 is connected to a shared duct 14*d* through a deformable duct 14*b* that has at least either flexibility or stretchability and an opening-closing damper 14*c* that is driven by, for example, an air cylinder. The shared duct 14*d* is connected to a suction port of the fan motor 13 fixedly disposed inside the apparatus main body 1, and the opening-closing dampers 14*c* and the fan motor 13 are controlled by the controller 12.

The sucking force maintaining means 14 has these controller 12, partition plates 14*a*, ducts 14*b*, 14*d*, and opening-closing dampers 14*c*, and further has, as a cloth width measurement part, a plurality of optical sensors 15 that is, as shown in FIG. 1, disposed on a front surface of the apparatus main body 1 in a row in the right-left direction and connected to the controller 12. The controller 12 recognizes the lateral width of the upper-side part of the cloth C to be spread by detecting the positions of side edges of the cloth C, of which the upper-side part has been spread in the right-left direction by the spreading unit 2, based on output signals of these optical sensors 15 indicating light reception (OFF) or light shielding by the cloth C (ON). Then, the controller 12 opens the opening-closing dampers 14*c* of the partitioned regions that are located at least partially within the lateral range corresponding to the lateral width of the upper-side part of the cloth C to be spread, among the multiple partitioned regions PR1 to 3 inside the catch base 3*a*, namely, those of the partitioned regions PR1, PR2 in the shown example, to thereby connect the partitioned regions PR1, PR2 to the fan motor 13, while closing the opening-closing dampers 14*c* of the partitioned regions PR3 that are located outside the lateral range corresponding to the lateral width of the upper-side part of the cloth C to be spread to thereby shut off the partitioned regions PR3 from the suction force of the fan motor 13.

Thus, as only the partitioned regions PR1, PR2 are turned into a negative pressure region, it is possible to prevent a decrease in the sucking force of the partitioned regions PR1, PR2 due to air entering the negative pressure region through the suction holes 3*b* in the partitioned regions PR3 that are not covered by the upper-side part of the cloth C to be spread, and to thereby maintain the sucking force of the catch base 3*a* regardless of whether the lateral width of the upper-side part of the cloth C to be spread is large or small.

Instead of using the plurality of optical sensors 15 as the cloth width measurement part, the controller 12 may detect, from the amount of operation of the motor etc., the amounts of movement or the stop positions of the pair of spreading clamps 2*b* at the time when the lateral moving device has laterally moved the spreading clamps 2*b* so as to spread the upper-side part of the cloth C to be spread, and, based on the detected amounts of movement or stop positions, recognize the partitioned regions that are located at least partially within the lateral range corresponding to the lateral width of the upper-side part of the cloth C to be spread. Or the controller 12 may have a switch as a cloth width input part, and a worker may operate this switch to input the partitioned regions that are located at least partially within the lateral range corresponding to the lateral width of the upper-side part of the cloth C to be spread.

The sucking force maintaining means may have fan motors 13 separately provided so as to correspond to respective partitioned regions PR1 to PR3 at the plurality of locations inside the catch base 3*a*. The controller 12 may turn those of the partitioned regions PR1 to PR3 at the plurality of locations that are located at least partially within the lateral range corresponding to the lateral width of the upper-side part of the cloth C to be spread into a negative pressure region by means of the separate fan motors 13 corresponding to those partitioned regions. In this case, as the suction force of the separate fan motors 13 need not be very high, a plurality of small-sized fan motors 13 may be fixedly disposed on a back part of the catch base 3*a*, instead of on the apparatus main body 1.

Figure 4:
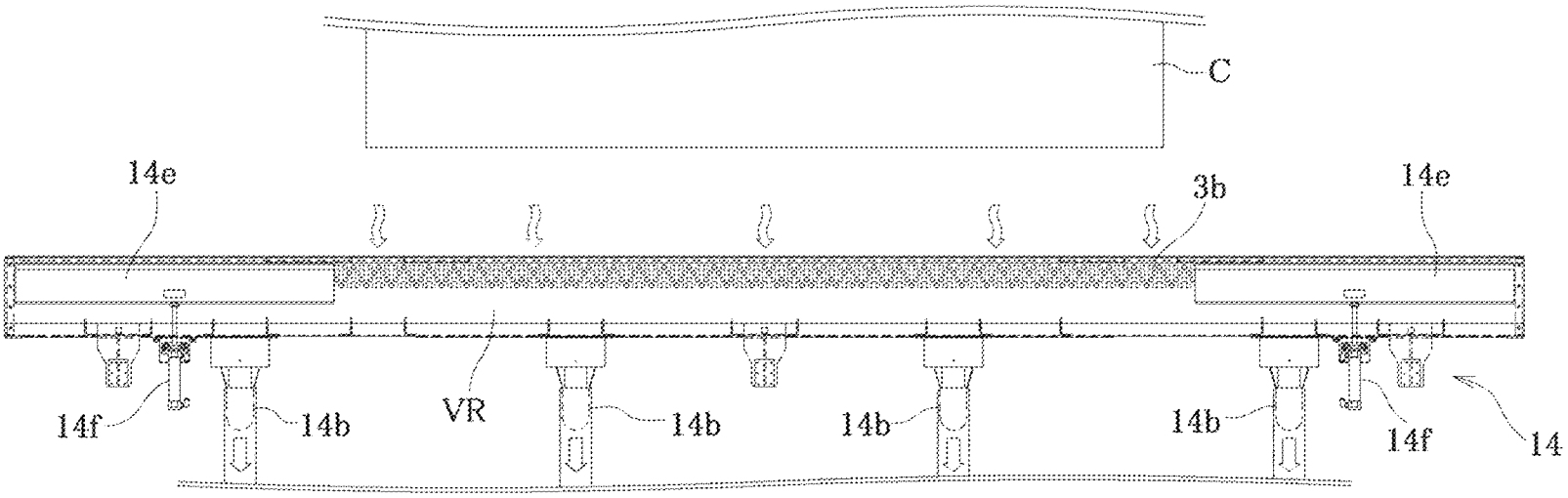
FIG. 4 is an illustration showing another example of the configuration of the ejection unit of the cloth spreading apparatus of the embodiment in the state where the intermediate movable body is seen from above.

FIG. 4 is an illustration showing another example of the configuration of the ejection unit of the cloth spreading apparatus of the above embodiment in the state where the intermediate movable body is seen from above. In this example of the configuration, a shared fan motor 13 is connected to the inside of the catch base 3*a*, at least over the lateral range corresponding to the set maximum lateral width of the upper-side part of the cloth C, in the shown example, the entire lateral range of the catch base 3*a*, through a plurality of deformable ducts 14*b* having at least either flexibility or stretchability, or a plurality of small-sized fan motors 13 fixedly installed on the catch base 3*a* is directly connected to the inside of the catch base 3*a*, to define a negative pressure region VR. This example of the configuration includes, for example, two shutter plates 14*e* that cover, from an inner side, the suction holes 3*b* located on both outer sides of the lateral range corresponding to the lateral width of the upper-side part of the cloth C to be spread to thereby shut off these suction holes 3*b* from the negative pressure region VR, and actuators 14*f*, such as air cylinders, that respectively drive these shutter plates 14*e* to open and close. The controller 12 opens and closes the shutter plates 14*e* by driving these actuators 14*f* according to the lateral width of the upper-side part of the cloth C to be spread.

Thus, as the suction holes 3*b* located on both outer sides of the lateral range corresponding to the lateral width of the upper-side part of the cloth C to be spread are covered by the shutter plates 14*e*, it is possible to prevent a decrease in the sucking force of the suction holes 3*b* within the lateral range corresponding to the lateral width of the upper-side part of the cloth C to be spread due to air entering the negative pressure region through those suction holes 3*b*, and to thereby maintain the sucking force of the catch base 3*a* regardless of whether the lateral width of the upper-side part of the cloth C to be spread is large or small. The numbers of the shutter plates 14*e* and the actuators 14*f* are not limited to two but may be larger numbers.

Figure 5:
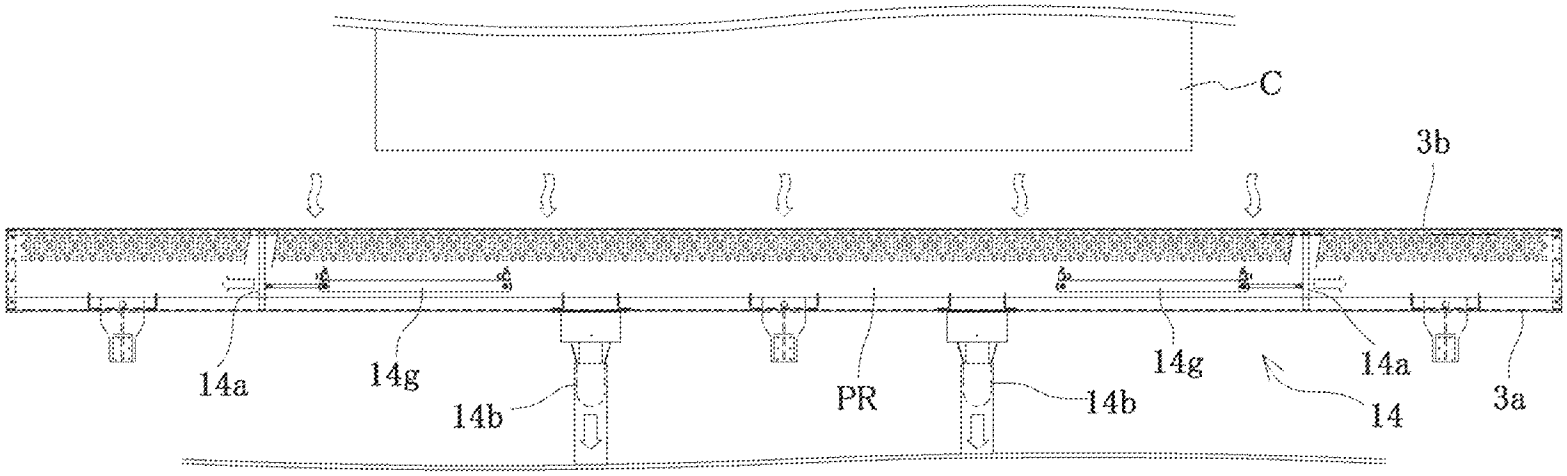
FIG. 5 is an illustration showing yet another example of the configuration of the ejection unit of the cloth spreading apparatus of the embodiment in the state where the intermediate movable body is seen from above.

FIG. 5 is an illustration showing yet another example of the configuration of the ejection unit of the cloth spreading apparatus of the above embodiment in the state where the intermediate movable body is seen from above. In this example of the configuration, a partitioned region PR is defined at one location inside the catch base 3*a* by two partition plates 14*a* as partition members that are disposed so as to be movable in the right-left direction of the catch base 3*a*. A shared fan motor 13 that is fixedly disposed in the apparatus main body 1 is connected to this partitioned region PR through a plurality of deformable ducts 14*b* having at least either flexibility or stretchability, or a plurality of small-sized fan motors 13 fixedly installed on the catch base 3*a* is directly connected to the partitioned region PR, to define a negative pressure region. This negative pressure region spans the lateral range corresponding to the lateral width of the upper-side part of the cloth C to be spread as the two partition plates 14*a* are moved continuously or stepwise in the right-left direction of the catch base 3*a* respectively by actuators 14*g*, such as linear actuators, that are controlled by the controller 12.

Thus, as the suction holes 3*b* located on both outer sides of the lateral range corresponding to the lateral width of the upper-side part of the cloth C to be spread are excluded from the negative pressure region, it is possible to prevent a decrease in the sucking force of the suction holes 3*b* within the lateral range corresponding to the lateral width of the upper-side part of the cloth C to be spread due to air entering the negative pressure region through those suction holes 3*b*, and to thereby maintain the sucking force of the catch base 3*a* regardless of whether the lateral width of the upper-side part of the cloth C to be spread is large or small.

While the present invention has been described above based on the shown examples, the present invention is not limited to the above-described examples but can be changed as necessary within the scope of the description of the claims. For example, in the cloth spreading apparatus of the above embodiment, the vertical spreading units 7 are provided at a lower part on the front side of the apparatus main body 1, and the lower part of each vertical spreading unit 7 is connected to the blower 9 through the duct 8. Behind the vertical spreading unit 7, the second duct 10 that allows communication between the vacuum box 4*b* of the primary conveyor 4 and the blower 9 is formed. The opening-closing plate 11 selectively opens and closes the opening of the duct 8 and the opening of the duct 10, and thereby switches between the state in which air is suctioned into the vertical spreading unit 7 and the state in which the vacuum box 4*b* of the primary conveyor 4 is operated. This blower 9 may also be used as the shared fan motor 13 fixedly disposed on the apparatus main body 1 to hold the upper-side part of the cloth C onto the catch base 3*a* by sucking.

In the cloth spreading apparatus of the present invention, a worker picks up adjacent corners of a long side of a washed cloth C that constitutes, for example, the upper side at the time of feeding, at one of the feeding units and makes the pair of feeding clamps in the feeding position respectively grasp these corners. Then, the raising-lowering device of that feeding unit raises the pair of feeding clamps to the delivery position to delivery the corners of the upper side to the pair of spreading clamps 2*b*. Instead of or in addition to this, a known cloth buffer device may be provided that stores a plurality of cloths in a row in a hanging state and sequentially hands over the cloths one by one to the spreading clamps 2*b*.

Further, the cloth C to which the cloth spreading apparatus of the present invention is applied may be a double-layered cloth of a relatively large size, such as a frame-shaped duvet cover that has a large opening at a central part of the front cloth, or a normal duvet cover that has no opening at a central part of the front cloth. Or the cloth C may be a double-layered cloth of a relatively small size, such as a pillow case (pillow cover), or may be a single cloth, such as a towel, a sheet, or a tablecloth. In the above embodiment, the ejection unit has either the cloth width measurement part that measures the lateral width of a cloth from the amount of movement of each of the pair of spreading clamps or the cloth width measurement part that measures the lateral width of a cloth of which the upper-side part has been spread by means of the plurality of optical sensors 15. Alternatively, the ejection unit may have both these cloth width measurement parts and use one or the other according to the situation.

Instead of opening and closing the shutter plates 14*e* by the actuators 14*f*, the controller 12 may control the fan motor 13 by an inverter or the like to increase or decrease the suction force according to the lateral width of the upper-side part of the cloth C to be spread.

INDUSTRIAL APPLICABILITY

Thus, according to the cloth spreading apparatus of the present invention, the sucking force of the intermediate movable body can be maintained at such strength as to be able to reliably suck the upper-side part of the cloth, without the need to provide a negative pressure source having a high suction force or to generate the high suction force of that negative pressure source at all times. It is therefore possible to inexpensively prevent cloths from falling from the intermediate movable body by achieving a lower cost of the negative pressure source and thereby of the cloth spreading apparatus and/or a reduction in power consumption of the negative pressure source during operation of the cloth spreading apparatus.

REFERENCE SIGNS LIST

1 Apparatus main body
2 Spreading unit
2*a* Air cylinder
2*b* Spreading clamp
2*c* Carriage
2*d* Rail
3 Ejection unit

3*a* Catch base
3*b* Suction hole
4 Primary conveyor
4*a* Conveyor belt
4*b* Vacuum box
Secondary conveyor
6 Temporary holding device
6*a* Temporary holding member
7 Vertical spreading unit
8, 10 Duct
9 Blower
11 Opening-closing plate
12 Controller
13 Fan motor
14 Sucking force maintaining means
14*a* Partition plate
14*b*, 14*d* Duct
14*c* Opening-closing damper
14*e* Shutter plate
14*f*, 14*g* Actuator
Optical sensor
C Cloth
PR, PR1 to PR3 Partitioned regions
VR Negative pressure region

The invention claimed is:

1. A cloth spreading apparatus comprising:

a spreading unit having a pair of spreading clamps that grasps adjacent corners of a fed cloth and spreads at least an upper-side part of the cloth between the corners in a right-left direction; and an ejection unit having:

an intermediate movable body that, while moving backward from a forward position, releases the upper-side part of the cloth that the intermediate movable body has received from the pair of spreading clamps in the forward position and held onto an upper surface by sucking; and a belt conveyor that receives the upper-side part of the cloth having been released by the intermediate movable body, and pulls in the upper-side part and also sequentially pulls up the rest of the cloth under the upper-side part to eject the entire cloth backward, the cloth spreading apparatus being characterized in that the ejection unit has:

a large number of suction holes that are dispersedly disposed in the upper surface of the intermediate movable body, at least over a lateral range corresponding to a set maximum lateral width of the upper-side part of the cloth, and allow communication between an inside and an outside of the intermediate movable body;

a negative pressure source that sucks out air inside the intermediate movable body to form a negative pressure region inside the intermediate movable body; and sucking force maintaining means that maintains a sucking force with which the suction holes suck the upper-side part of the cloth, regardless of whether the lateral width of the upper-side part of the cloth is large or small.

2. The cloth spreading apparatus according to claim 1, wherein:

inside the intermediate movable body, partitioned regions are defined at a plurality of locations in the right-left direction by partition members that are fixedly disposed; and the sucking force maintaining means turns those of the partitioned regions at the plurality of locations inside the intermediate movable body that are located at least partially within a lateral range corresponding to a lateral width of the upper-side part of the cloth into the negative pressure region by means of the negative pressure source that is shared.

3. The cloth spreading apparatus according to claim 2, wherein:

the ejection unit has a cloth width measurement part that measures a lateral width of the cloth from an amount of movement of each of the pair of spreading clamps upon spreading at least the upper-side part of the cloth in the right-left direction; and based on the measured lateral width of the cloth, the sucking force maintaining means maintains the sucking force with which the cloth is sucked onto the upper surface of the intermediate movable body.

4. The cloth spreading apparatus according to claim 3, wherein:

the ejection unit has a cloth width measurement part that measures a lateral width of the cloth in a state where at least the upper-side part has been spread in the right-left direction by the pair of spreading clamps; and based on the measured lateral width of the cloth, the sucking force maintaining means maintains the sucking force with which the cloth is sucked onto the upper surface of the intermediate movable body.

5. The cloth spreading apparatus according to claim 2, wherein:

the ejection unit has a cloth width measurement part that measures a lateral width of the cloth in a state where at least the upper-side part has been spread in the right-left direction by the pair of spreading clamps; and based on the measured lateral width of the cloth, the sucking force maintaining means maintains the sucking force with which the cloth is sucked onto the upper surface of the intermediate movable body.

6. The cloth spreading apparatus according to claim 1, wherein:

inside the intermediate movable body, the negative pressure region is defined by the negative pressure source at least over the lateral range corresponding to the set maximum lateral width of the upper-side part of the cloth; and the sucking force maintaining means covers those of the suction holes that are located outside a lateral range corresponding to a lateral width of the upper-side part of the cloth so as to shut off those suction holes from the negative pressure region.

7. The cloth spreading apparatus according to claim 6, wherein:

the ejection unit has a cloth width measurement part that measures a lateral width of the cloth from an amount of movement of each of the pair of spreading clamps upon spreading at least the upper-side part of the cloth in the right-left direction; and based on the measured lateral width of the cloth, the sucking force maintaining means maintains the sucking force with which the cloth is sucked onto the upper surface of the intermediate movable body.

8. The cloth spreading apparatus according to claim 7, wherein:

the ejection unit has a cloth width measurement part that measures a lateral width of the cloth in a state where at least the upper-side part has been spread in the right-left direction by the pair of spreading clamps; and based on the measured lateral width of the cloth, the sucking force maintaining means maintains the sucking force with which the cloth is sucked onto the upper surface of the intermediate movable body.

9. The cloth spreading apparatus according to claim 6, wherein:

the ejection unit has a cloth width measurement part that measures a lateral width of the cloth in a state where at least the upper-side part has been spread in the right-left direction by the pair of spreading clamps; and based on the measured lateral width of the cloth, the sucking force maintaining means maintains the sucking force with which the cloth is sucked onto the upper surface of the intermediate movable body.

10. The cloth spreading apparatus according to claim 1, wherein:

partition members that are movable in the right-left direction are disposed inside the intermediate movable body; and the sucking force maintaining means defines a partitioned region inside the intermediate movable body, over a lateral range corresponding to a lateral width of the upper-side part of the cloth, by moving the partition members in the right-left direction, and turns this partitioned region into the negative pressure region by means of the negative pressure source.

11. The cloth spreading apparatus according to claim 10, wherein:

the ejection unit has a cloth width measurement part that measures a lateral width of the cloth from an amount of movement of each of the pair of spreading clamps upon spreading at least the upper-side part of the cloth in the right-left direction; and based on the measured lateral width of the cloth, the sucking force maintaining means maintains the sucking force with which the cloth is sucked onto the upper surface of the intermediate movable body.

12. The cloth spreading apparatus according to claim 11, wherein:

the ejection unit has a cloth width measurement part that measures a lateral width of the cloth in a state where at least the upper-side part has been spread in the right-left direction by the pair of spreading clamps; and based on the measured lateral width of the cloth, the sucking force maintaining means maintains the sucking force with which the cloth is sucked onto the upper surface of the intermediate movable body.

13. The cloth spreading apparatus according to claim 10, wherein:

the ejection unit has a cloth width measurement part that measures a lateral width of the cloth in a state where at least the upper-side part has been spread in the right-left direction by the pair of spreading clamps; and based on the measured lateral width of the cloth, the sucking force maintaining means maintains the sucking force with which the cloth is sucked onto the upper surface of the intermediate movable body.

14. The cloth spreading apparatus according to claim 1, wherein:

the ejection unit has a cloth width measurement part that measures a lateral width of the cloth from an amount of movement of each of the pair of spreading clamps upon spreading at least the upper-side part of the cloth in the right-left direction; and based on the measured lateral width of the cloth, the sucking force maintaining means maintains the sucking force with which the cloth is sucked onto the upper surface of the intermediate movable body.

15. The cloth spreading apparatus according to claim 14, wherein:

the ejection unit has a cloth width measurement part that measures a lateral width of the cloth in a state where at least the upper-side part has been spread in the right-left direction by the pair of spreading clamps; and based on the measured lateral width of the cloth, the sucking force maintaining means maintains the sucking force with which the cloth is sucked onto the upper surface of the intermediate movable body.

16. The cloth spreading apparatus according to claim 1, wherein:

the ejection unit has a cloth width measurement part that measures a lateral width of the cloth in a state where at least the upper-side part has been spread in the right-left direction by the pair of spreading clamps; and based on the measured lateral width of the cloth, the sucking force maintaining means maintains the sucking force with which the cloth is sucked onto the upper surface of the intermediate movable body.

* * * * *